US008742276B2

(12) United States Patent
Zhang

(10) Patent No.: US 8,742,276 B2
(45) Date of Patent: Jun. 3, 2014

(54) PRESS KEY

(75) Inventor: Qing Zhang, Changshu (CN)

(73) Assignee: Changshu Sunrex Technology Co., Ltd., Changshu, Jiangsu Province (CN)

( * ) Notice: Subject to any disclaimer, the term of this patent is extended or adjusted under 35 U.S.C. 154(b) by 233 days.

(21) Appl. No.: 13/478,273

(22) Filed: May 23, 2012

(65) Prior Publication Data

US 2013/0313096 A1 Nov. 28, 2013

(51) Int. Cl.
*H01H 13/14* (2006.01)

(52) U.S. Cl.
USPC ..... 200/520; 200/344; 200/314; 200/5 A

(58) Field of Classification Search
USPC ..... 200/520, 344, 314, 513, 5 A; 341/20–22; 345/157–168
See application file for complete search history.

(56) References Cited

U.S. PATENT DOCUMENTS

| | | | | |
|---|---|---|---|---|
| 7,709,760 | B2 * | 5/2010 | Chen et al. | 200/314 |
| 8,119,945 | B2 * | 2/2012 | Lin | 200/314 |
| 8,164,017 | B2 * | 4/2012 | Cheng | 200/344 |
| 8,212,167 | B2 * | 7/2012 | Chen | 200/345 |
| 8,326,373 | B2 * | 12/2012 | Song et al. | 455/574 |

* cited by examiner

*Primary Examiner* — Kyung Lee
(74) *Attorney, Agent, or Firm* — Brinks Gilson & Lione

(57) ABSTRACT

A press key includes: a base unit having a metal plate; a position-limiting unit formed with a through hole, the metal plate and the position-limiting unit defining an accommodating space therebetween; a keycap movable between a raised position and a pressed position and including a cap body that corresponds in position to the through hole, and a flange member that extends outwardly from and around the cap body and that abuts against the position-limiting unit when the keycap is at the raised position; and an elastic restoring unit including a scissors-type lever that is connected pivotally to the keycap and the position-limiting unit.

8 Claims, 4 Drawing Sheets

PRESS KEY

BACKGROUND OF THE INVENTION

1. Field of the Invention

This invention relates to a press key, and more particularly to a press key that is easy to assemble.

2. Description of the Related Art

Referring to FIGS. 1 and 2, a conventional press key 1 comprises a metal plate 11, a circuit board 12, an elastic restoring unit 13, and a keycap 14 adapted to be pressed.

The metal plate 11 is, for example, molded to have a patterned surface 111 with projections and recesses so as to engage the elastic restoring unit 13.

The circuit board 12 is disposed on the metal plate 11, and has a predetermined trace pattern that is designed to correspond to the patterned surface 111 of the metal plate 11.

The elastic restoring unit 13 includes a scissors-type lever 131 and an elastic member 132. The scissors-type lever 131 is connected to the keycap 14 and the patterned surface 111 of the metal plate 11, so that the keycap 14 can move upward and downward relative to the metal plate 11. The elastic member 132 is made of a rubber material that has a resilient restoring force and is disposed between the circuit board 12 and the keycap 14. When the keycap 14 is pressed by an external force, the elastic member 132 is deformed to contact the circuit board 12 to produce a signal. When the external force is removed from the keycap 14, the elastic member 132 may restore to move the keycap 14 away from the circuit board 12 by virtue of the resilient restoring force.

The disadvantage of the conventional press key 1 is that, in order to match the arrangement of the scissors-type lever 131, the patterned surface 111 with projections and recesses for fixing the scissors-type lever 131 must be formed using, for example, a mold. Therefore, the manufacturing cost is high. In addition, the circuit layout of the circuit board 12 is restricted by the arrangement of the elastic restoring unit 13.

Besides, to see clearly and use the press key in a dark place, a conventional light-transmissive press key 1' has been developed based on the configuration of the press key 1 shown in FIGS. 1 and 2 (see FIG. 3). The light-transmissive press key 1' has a keycap 14 that is made of a transparent material, and a light-guiding member 15 that includes laminated light-guiding sheet and reflective sheet. Due to the patterned surface 111, the light-guiding member 15 can only be mounted on a bottom surface of the metal plate 11, and most of the light guided by the light-guiding member 15 may be reflected or blocked by the metal plate 11. Therefore, the brightness of the light-transmissive press key 1' is not sufficient and the illumination is not uniform.

SUMMARY OF THE INVENTION

Therefore, an object of the present invention is to provide a press key that can overcome at least one of the aforesaid drawbacks associated with the prior art.

Accordingly, a press key of this invention comprises:

a base unit including a metal plate;

a position-limiting unit disposed above and coupled to the metal plate and formed with a through hole, the metal plate and the position-limiting unit defining an accommodating space therebetween;

a keycap movable between a raised position and a pressed position and including a cap body that corresponds in position to the through hole, and a flange member that extends outwardly from and around the cap body and that abuts against the position-limiting unit when the keycap is at the raised position; and an elastic restoring unit disposed in the accommodating space, connected to the keycap, and capable of providing a restoring force to move the keycap from the pressed position to the raised position through the through hole, the elastic restoring unit including a scissors-type lever that is connected pivotally to the keycap and the position-limiting unit.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
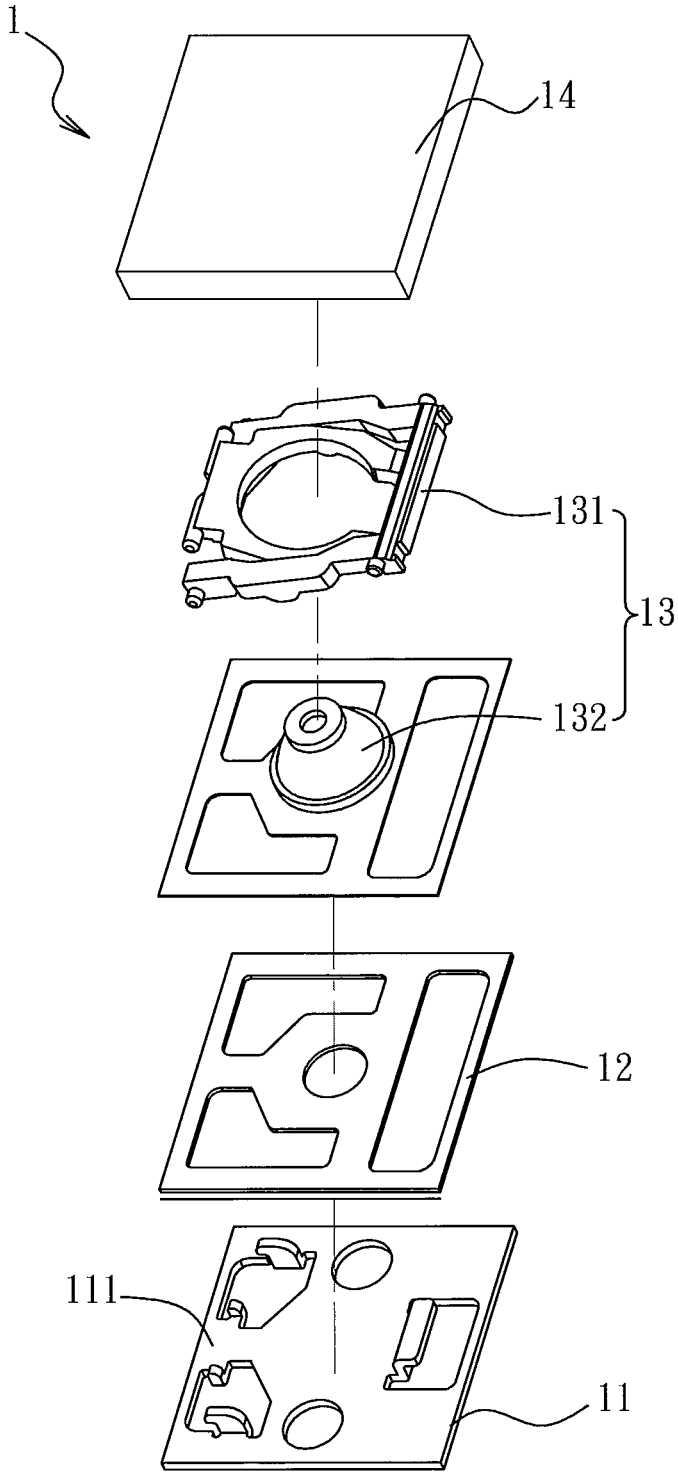
F I G. 1 PRIOR ART
FIG. 1 is an exploded perspective view of a conventional press key.
Figure 2:
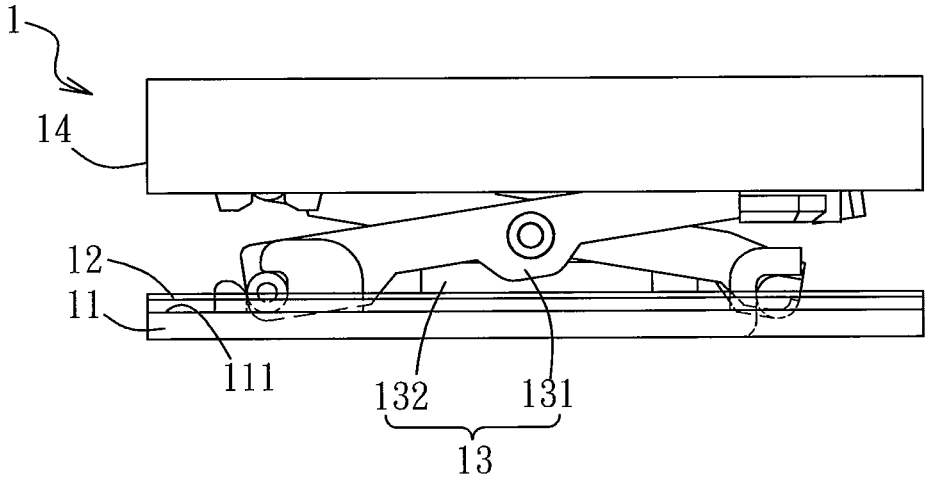
F I G. 2 PRIOR ART
FIG. 2 is a schematic side view of the conventional press key of FIG. 1.
Figure 3:
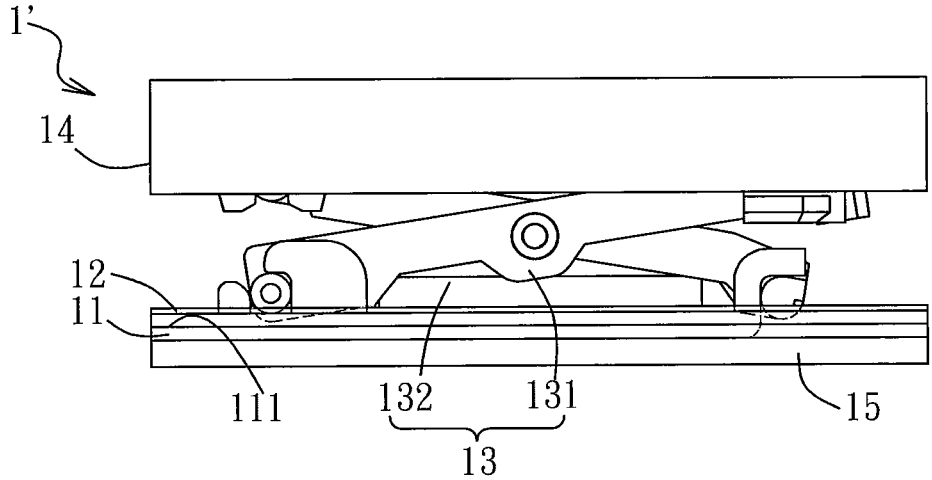
F I G. 3 PRIOR ART
FIG. 3 is a schematic side view of a conventional light-transmissive press key.

Before the present invention is described in greater detail with reference to the accompanying preferred embodiments, it should be noted herein that like elements are denoted by the same reference numerals throughout the disclosure.

Figure 4:
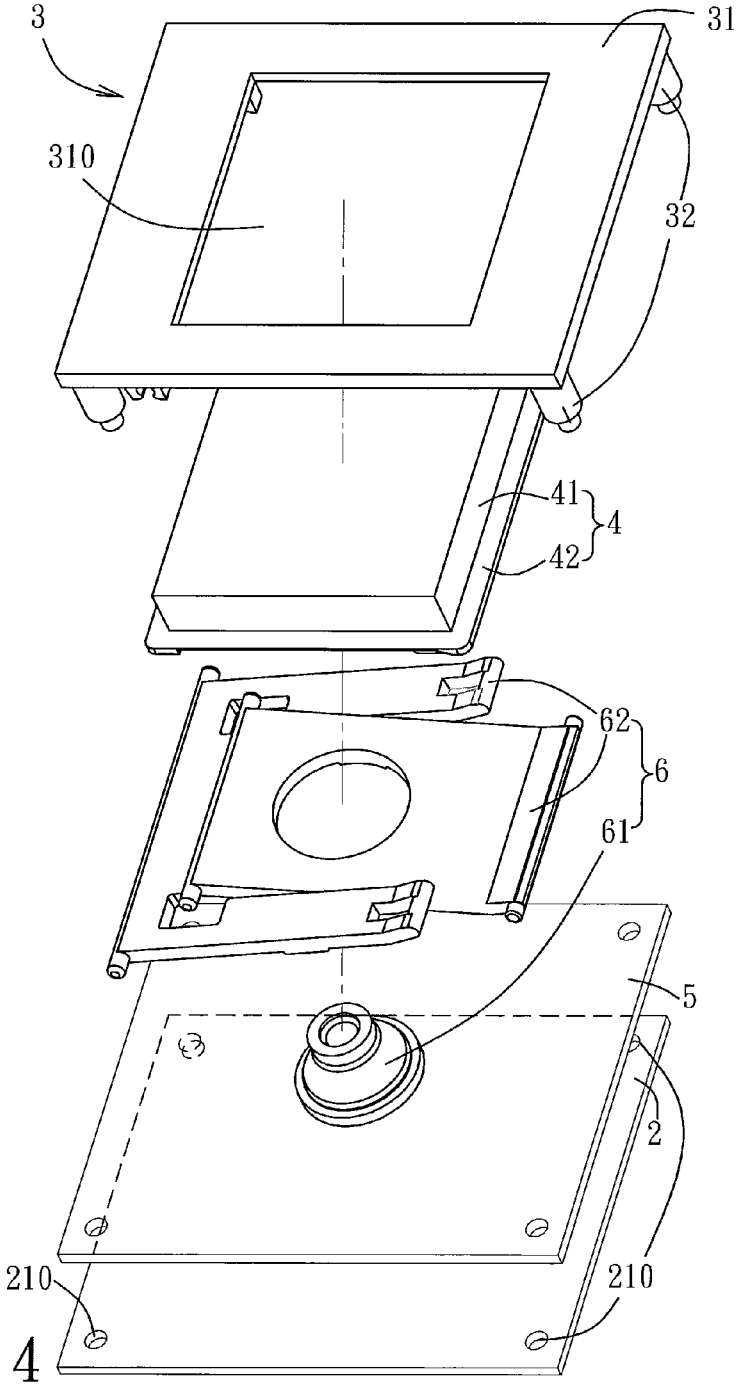
FIG. 4 is an exploded perspective view of the first preferred embodiment of a press key according to the present invention.
Figure 5:
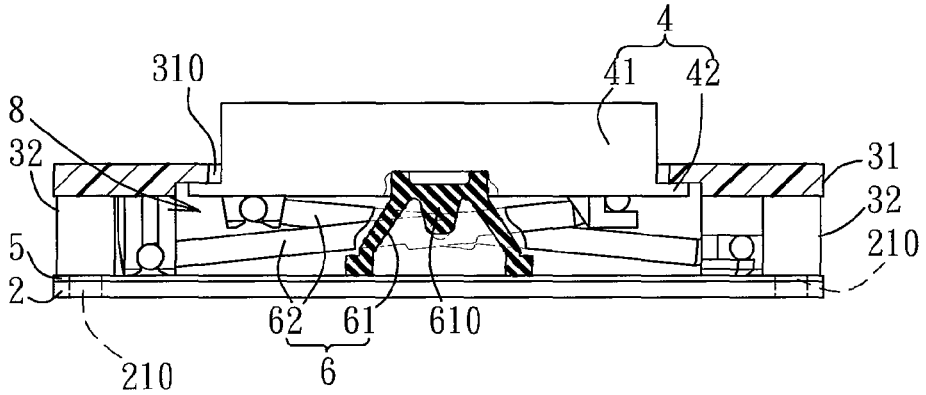
FIG. 5 is a partly sectional view of the first preferred embodiment.

Referring to FIGS. 4 and 5, the first preferred embodiment of a press key of the present invention comprises a base unit including a metal plate 2, a position-limiting unit 3, a keycap 4, a circuit board 5, and an elastic restoring unit 6.

The metal plate 2 is a generally rectangular and smooth plate and includes four recesses 210 that are formed respectively in four corners of the metal plate 2.

The position-limiting unit 3 is disposed above and coupled to the metal plate 2 and is formed with a through hole 310. The metal plate 2 and the position-limiting unit 3 define an accommodating space 8 therebetween. The position-limiting unit 3 includes a bordering plate 31 formed with the through hole 310, and four supporting legs 32 each extending from the bordering plate 31 and inserted into a respective one of the recesses 210 to couple to the metal plate 2. The through hole 310 is in spatial communication with the accommodating space 8. It is noted that the number and position of the supporting legs 32 are determined with respect to those of the recesses 210 of the metal plate 2 and are not limited to those of the preferred embodiment.

The keycap 4 is movable between a raised position and a pressed position and includes a cap body 41 that corresponds in position to the through hole 310 of the position-limiting unit 3, and a flange member 42 that extends outwardly from and around the cap body 41 and that abuts against the position-limiting unit 3 when the keycap 4 is at the raised position.

The circuit board 5 is disposed on the metal plate 2 in the accommodating space 8. In general, the circuit board 5 is a thin film circuit board or a printed circuit board.

The elastic restoring unit 6 is disposed in the accommodating space 8, connected to the keycap 4, and capable of providing a restoring force to move the keycap 4 from the pressed position to the raised position through the through hole 310.

In this embodiment, the elastic restoring unit 6 includes an elastic member 61 disposed between and connected to the keycap 4 and the circuit board 5, and has a contact 610. When the keycap 4 is moved to the pressed position, the contact 610 of the elastic member 61 is pressed to contact the circuit board 5 to produce a signal. The elastic restoring unit 6 further includes a scissors-type lever 62 that is connected pivotally to the keycap 4 and the position-limiting unit 3. The elastic member 61 is made of a rubber material or is in the form of a spring, and the scissors-type lever 62 is configured as a common scissors supporting structure.

Since the scissors-type lever 62 of the elastic restoring unit 6 is connected to the position-limiting unit 3, a complicated structure is not required for the metal plate 2 to dispose the scissors-type lever 62. The metal plate 2 of the press key of the present invention can be configured in the form of a flat and smooth plate, thereby dramatically reducing the cost due to a metal molding process and overcoming the aforementioned drawback associated with the conventional press key 1. In addition, since the surface of the metal plate 2 is flat and smooth, the layout of the circuit board 5 would not be limited by the configuration of the metal plate 2, thereby facilitating further reduction of the manufacturing cost.

Figure 6:
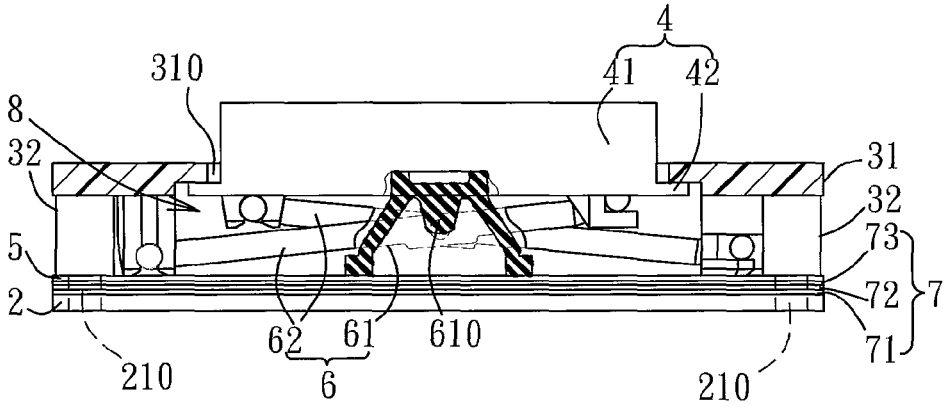
FIG. 6 is a partly sectional view of the second preferred embodiment of a press key according to the present invention.

Referring to FIG. 6, the press key of the second preferred embodiment of the present invention is similar to that of the first preferred embodiment, except that the base unit further includes a light-guiding member 7 disposed between the circuit board 5 and the metal plate 2. In addition, the cap body 41 of the keycap 4 is made of a light-transmissive material.

The light-guiding member 7 includes a reflective sheet 71 disposed on the metal plate 2, a light-guiding sheet 72 disposed on the reflective sheet 71, and a protective sheet 73 disposed on the light-guiding sheet 72. With this arrangement, external light (not shown) from both sides of the press key may be guided into the accommodating space 8 and transmitted toward the cap body 41 of the keycap 4. The external light is thus mixed, reflected and refracted and emits toward the keycap 4 in the form of a planar light source. The reflective sheet 71 functions to reflect more light emitted toward the metal plate 2 back to the light-guiding sheet 72. The protective sheet 73 is used to protect the light-guiding sheet 72 and has a predetermined light transmittance so that the light transmitted toward the keycap 4 may not be blocked. Therefore, the light can be transmitted to the external environment through the keycap 4, so that the press key can be seen clearly in a dark place.

It is noted that the light-guiding member 7 of the press key of the second preferred embodiment is disposed in the accommodating space 8 defined by the metal plate 2 and the keycap 4. Therefore, the light-guiding member 7 can not only be protected from being damaged by means of the metal plate 2, but also prevent the light transmitted from the light-guiding member 7 toward the keycap 4 from being blocked by the metal plate 2, thereby greatly increasing the brightness of the press key.

To sum up, the movement of the keycap 4 can be further limited by the abutment of the flange member 42 against the bordering plate 31 of the position-limiting unit 3. Moreover, by connecting the scissors-type lever 62 to the position-limiting unit 3, the manufacturing cost for molding the metal plate 2 can be eliminated, and layout limitation of the circuit board 5 can be avoided. In addition, the light-guiding member 7 disposed between the metal plate 2 and the keycap 4 can be protected by the metal plate 2 and could improve brightness of the press key.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. A press key comprising:

a base unit including a metal plate;

a position-limiting unit disposed above and coupled to said metal plate and formed with a through hole, said metal plate and said position-limiting unit defining an accommodating space therebetween;

a keycap movable between a raised position and a pressed position and including a cap body that corresponds in position to said through hole, and a flange member that extends outwardly from and around said cap body and that abuts against said position-limiting unit when said keycap is at the raised position; and an elastic restoring unit disposed in said accommodating space, connected to said keycap, and capable of providing a restoring force to move said keycap from the pressed position to the raised position through said through hole, said elastic restoring unit including a scissors-type lever that is connected pivotally to said keycap and said position-limiting unit.

2. The press key of claim 1, wherein said position-limiting unit includes a bordering plate formed with said through hole, and a plurality of supporting legs each extending from said bordering plate and coupled to said metal plate, said scissors-type lever being connected pivotally to said keycap and said bordering plate.

3. The press key of claim 1, wherein said through hole is in spatial communication with said accommodating space.

4. The press key of claim 2, wherein said metal plate is formed with a plurality of recesses, each of said supporting legs extending into a respective one of said recesses.

5. The press key of claim 2, further comprising a circuit board disposed on said metal plate in said accommodating space.

6. The press key of claim 5, wherein said base unit further has a light-guiding member disposed between said circuit board and said metal plate.

7. The press key of claim 6, wherein said light-guiding member includes a reflective sheet disposed on said metal plate, a light-guiding sheet disposed on said reflective sheet, and a protective sheet disposed on said light-guiding sheet.

8. The press key of claim 5, wherein said elastic restoring unit further includes an elastic member disposed between and connected to said keycap and said circuit board, and having a contact, and when said keycap is moved to the pressed position, said contact of said elastic member is pressed to contact said circuit board to produce a signal.

* * * * *